US007047750B2

(12) United States Patent
Mita et al.

(10) Patent No.: US 7,047,750 B2
(45) Date of Patent: May 23, 2006

(54) PULSE TUBE REFRIGERATING MACHINE

(75) Inventors: Hideo Mita, Aichi-ken (JP); Tetuya Gotou, Aichi-ken (JP); Motohiro Igarasi, Aichi (JP); Takayuki Furusawa, Aichi (JP)

(73) Assignees: Aisin Seiki Kabushiki Kaisha, Kariya (JP); Central Japan Railway Company, Nagoya (JP)

( * ) Notice: Subject to any disclaimer, the term of this patent is extended or adjusted under 35 U.S.C. 154(b) by 33 days.

(21) Appl. No.: 10/486,355

(22) PCT Filed: Aug. 29, 2002

(86) PCT No.: PCT/JP02/08733

§ 371 (c)(1),
(2), (4) Date: Oct. 4, 2004

(87) PCT Pub. No.: WO03/019087

PCT Pub. Date: Mar. 6, 2003

(65) Prior Publication Data

US 2005/0044860 A1 Mar. 3, 2005

(30) Foreign Application Priority Data

Aug. 30, 2001 (JP) ..... 2001-262282

(51) Int. Cl.
*F25B 9/00* (2006.01)

(52) U.S. Cl. ..... 62/6; 62/513

(58) Field of Classification Search ..... 62/6, 62/113, 513

See application file for complete search history.

(56) References Cited

U.S. PATENT DOCUMENTS

| | | | | |
|---|---|---|---|---|
| 5,107,683 | A * | 4/1992 | Chan et al. | 62/6 |
| 6,205,812 | B1 * | 3/2001 | Acharya et al. | 62/6 |
| 6,374,617 | B1 * | 4/2002 | Bonaquist et al. | 62/6 |
| 6,389,819 | B1 * | 5/2002 | Zhu et al. | 62/6 |

FOREIGN PATENT DOCUMENTS

| | | | |
|---|---|---|---|
| JP | 3-194364 | | 8/1991 |
| JP | 4-268167 | | 9/1992 |
| JP | 04313649 | A * | 11/1992 |
| JP | 05312423 | A * | 11/1993 |
| JP | 6-137696 | | 5/1994 |
| JP | 07180938 | A * | 7/1995 |
| JP | 8-54151 | | 2/1996 |
| JP | 8-271071 | | 10/1996 |
| JP | 09004936 | A * | 1/1997 |
| JP | 10325626 | A * | 12/1998 |
| JP | 11014174 | A * | 1/1999 |
| JP | 2000-55491 | | 2/2000 |
| JP | 2001091076 | A * | 4/2001 |

* cited by examiner

*Primary Examiner*—Melba N. Bumgarner
*Assistant Examiner*—Richard L. Leung
(74) *Attorney, Agent, or Firm*—Oblon, Spivak, McClelland, Maier & Neustadt, P.C.

(57) ABSTRACT

A pulse tube refrigerating machine, comprising a pulse tube (11) connected to a regenerator (9) and having a hot end part (11*a*) being heated, in which a cooling device (30), for cooling the hot side tube wall (11*cd*) of the pulse tube by cooling medium lower in temperature than the hot side tube wall of the pulse tube, cools the hot side tube wall (11*cd*) of the pulse tube by coolant flowing from the pressure source (1) of the pulse tube refrigerating machine into the regenerator (9).

17 Claims, 14 Drawing Sheets

PULSE TUBE REFRIGERATING MACHINE

TECHNICAL FIELD

The present invention relates to a pulse tube refrigerator comprising a pulse tube connected to a cold reservoir and having a hot end that generates heat.

BACKGROUND ART

A conventional pulse tube refrigerator (Japanese Patent Application Laid-Open (kokai) No. 8-271071) is constructed as shown in FIG. 14. A high-pressure port 108*a* of a pressure vibration source 101 is connected to a main changeover valve 111, and a port 111*h* of the main changeover valve 111 communicates with a cold reservoir 103, a heat absorber 104, and a pulse tube 105 via a heat radiating unit passage 112. A hot end 105*c* of the pulse tube 105 is connected, through flow-rate adjustment means 122, to a first heat transfer tube 116 having a tubular shape and a port 106*p* of a phase adjustment changeover valve 106. The phase adjustment changeover valve 106 is connected to the high-pressure port 108*a* and a low-pressure port 108*b* of the pressure vibration source 101.

In the above conventional pulse tube refrigerator, when refrigerant flows from the phase adjustment changeover valve 106 into the hot end 105*c* of the pulse tube 105 via the flow-rate adjustment means 122, the refrigerant undergoes adiabatic compression, whereby the gas temperature within the pulse tube increases, and the wall temperature of the pulse tube 105 elevates to about 120° C. in a range extending from the hot end 105*c* of the pulse tube 105 to a longitudinally central portion of the pulse tube. Accordingly, the above conventional pulse tube refrigerator has a problem in that heat of the hot gas within the pulse tube 105 and heat of the wall of the pulse tube 105 are conducted to a cold end of the pulse tube 105, to thereby lower refrigeration capacity.

Moreover, since a heat radiating unit 102 of a heat exchange unit A is interposed between the main changeover valve 111 and the cold reservoir 103, the above conventional pulse tube refrigerator has a problem in that the free gas space increases, thereby decreasing the refrigeration capacity of the refrigerator.

DISCLOSURE OF THE INVENTION

In view of technical requirements of reducing the quantity of heat conducting to the cold end of the pulse tube 105 and the free gas space of the heat radiating unit 102 of the heat exchange unit A, the present inventor has conceived a technical idea of the present invention such that, in a pulse tube refrigerator having a pulse tube connected to a cold reservoir and having a hot end that generates heat, a high-temperature-side portion on the wall of the pulse tube is cooled by means of cooling medium which is lower in temperature than the high-temperature-side wall portion of the pulse tube.

Based on the technical concepts of the present invention, the inventors of the present invention have made further extensive studies and developments, thus arrived at completion of the present invention.

It is an object of the present invention to increase a refrigerating capacity of a pulse tube refrigerator.

The present invention provides a pulse tube refrigerator which comprises a pulse tube connected to a cold reservoir and having a hot end that generates heat, and cooling means for cooling a high-temperature-side portion on the wall of the pulse tube by use of cooling medium which is lower in temperature than the high-temperature-side portion on the wall of the pulse tube.

The present invention according to the first invention provides a pulse tube refrigerator in which the cooling means cools the high-temperature-side portion on the wall of the pulse tube by use or refrigerant of the pulse tube refrigerator.

The present invention according to the first invention provides a pulse tube refrigerator in which the cooling means cools the high-temperature-side portion on the wall of the pulse tube by use of atmospheric air.

The present invention according to the second invention provides a pulse tube refrigerator in which the cooling means cools the high-temperature-side portion on the wall of the pulse tube by use of refrigerant which flows out of a pressure source and flows into the cold reservoir.

The present invention according to the second invention provides a pulse tube refrigerator in which the cooling means cools the high-temperature-side portion on the wall of the pulse tube by use of refrigerant which flows between a discharge port of a pressure source and a high-pressure inlet port of a changeover valve communicating with the discharge port of the pressure source.

The present invention according to the second invention provides a pulse tube refrigerator in which the cooling means cools the high-temperature-side portion on the wall of the pulse tube by use of refrigerant which flows out of the cold reservoir and flows into a pressure source.

The present invention according to the second invention provides a pulse tube refrigerator in which the cooling means cools the high-temperature-side portion on the wall of the pulse tube by use of refrigerant which flows between a low-pressure outlet port of a changeover valve and a suction port of a pressure source.

The present invention according to the second invention provides a pulse tube refrigerator in which the cooling means cools the high-temperature-side portion on the wall of the pulse tube by use of refrigerant from a compressor provided separately.

The present invention according to the second invention provides a pulse tube refrigerator in which the cooling means cools a heat radiating unit disposed at the hot end of the pulse tube, by use of refrigerant which flows between a discharge side of a pressure source and a high-pressure inlet port of a changeover valve communicating with the discharge side of the pressure source.

The present invention according to the second invention provides a pulse tube refrigerator in which the cooling means cools a heat radiating unit disposed at the hot end of the pulse tube, by use of refrigerant which flows between a suction port of a pressure source and a low-pressure outlet port of a changeover valve communicating with the suction port of the pressure source.

The present invention according to the second invention provides a pulse tube refrigerator in which a radiator is provided between a suction port of a pressure source and a low-pressure outlet port of a changeover valve communicating with the suction port of the pressure source; the cooling means cools the high-temperature-side portion on the wall of the pulse tube by use of refrigerant flowing out of the low-pressure outlet port of the changeover valve; and the refrigerant used to cool the high-temperature-side portion on the wall of the pulse tube is cooled by use of the radiator.

The present invention according to the second invention provides a pulse tube refrigerator in which a radiator is provided between a suction port of a pressure source and a low-pressure outlet port of a changeover valve communicating with the suction port of the pressure source; the cooling means cools a heat radiating unit disposed at the hot end of the pulse tube by use of refrigerant flowing out of the low-pressure outlet port of the changeover valve; and the refrigerant used to cool the heat radiating unit is cooled by use of the radiator.

The present invention according to the third invention provides a pulse tube refrigerator in which the cooling means is constituted by a high-temperature-side portion on the wall of the pulse tube disposed in the atmosphere.

The present invention according to the thirteenth invention provides a pulse tube refrigerator in which fins are provided on an outer circumferential surface of the high-temperature-side portion on the wall of the pulse tube disposed in the atmosphere.

The present invention according to the thirteenth invention or the fourteenth invention provides a pulse tube refrigerator in which air is forcedly supplied to the high-temperature-side portion of the wall of the pulse tube.

The present invention according to the thirteenth invention provides a pulse tube refrigerator in which the high-temperature-side portion on the wall of the pulse tube disposed in the atmosphere is formed of a member having good heat conduction; a low-temperature-side portion on the wall of the pulse tube disposed within a vacuum tank is formed of a member having poor heat conduction; and the high-temperature-side portion and the low-temperature-side portion are joined together.

The present invention according to the thirteenth invention provides a pulse tube refrigerator in which one end of a conducting member is disposed in thermal contact with the high-temperature-side portion on the wall of the pulse tube, and the other end of the conducting member is disposed in thermal contact with a cooling source which is lower in temperature than the high-temperature-side portion on the wall of the pulse tube.

The present invention according to the seventeenth invention provides a pulse tube refrigerator in which the cooling source is formed of a vacuum tank of the refrigerator.

In the pulse tube refrigerator of the first invention having the above-described construction the cooling means cools the high-temperature-side portion on the wall of the pulse tube by use of cooling medium which is lower in temperature than the high-temperature-side portion on the wall of the pulse tube. Therefore, the pulse tube refrigerator of the present invention accomplishes the effect of increasing the refrigerating capacity.

In the pulse tube refrigerator of the second invention having the above-described construction according to the first invention, the cooling means cools the high-temperature-side portion on the wall of the pulse tube by use of refrigerant of the pulse tube refrigerator. Therefore the pulse tube refrigerator of the second invention accomplishes the effect of increasing the refrigerating capacity as a result of a decrease in the quantity of heat which reaches a cold end of the pulse tube because of movement of refrigerant gas.

In the pulse tube refrigerator of the third invention having the above-described construction according to the first invention, the cooling means cools the high-temperature-side portion on the wall of the pulse tube by use of atmospheric air. Therefore, the pulse tube refrigerator of the third invention accomplishes the effect of increasing the refrigerating capacity.

In the pulse tube refrigerator of the fourth invention having the above-described construction according to the second invention, the cooling means cools the high-temperature-side portion on the wall of the pulse tube by use of refrigerant which flows out of the pressure source and flows into the cold reservoir. Accordingly, in the pulse tube refrigerator of the present invention, when refrigerant flows from a phase adjuster to the pulse tube, the gas temperature at the high-temperature side of the pulse tube increases; and refrigerant flows from the phase adjuster toward the pulse tube in synchronism with the timing at which refrigerant flows out of a pressure source and flows into the cold reservoir. Therefore, the high-temperature-side wall portion of the pulse tube is cooled effectively and refrigerant at the high-temperature side of the pulse tube is cooled effectively via the wall. Moreover, the pulse tube refrigerator of the fourth invention accomplishes the effect of increasing the refrigerating capacity.

In the pulse tube refrigerator of the fifth invention having the above-described construction according to the second invention, the cooling means cools the high-temperature-side portion on the wall of the pulse tube by use of refrigerant which flows between a discharge port of a pressure source and the high-pressure inlet port of the changeover valve communicating with the discharge port of the pressure source. Therefore, in the pulse tube refrigerator of the present invention, the high-temperature-side wall portion of the pulse tube and refrigerant at the high-temperature side of the pulse tube are cooled, and such cooling is effected by use of refrigerant flowing between a discharge port of the pressure source and an inflow side of the changeover valve. Therefore, even when the high-temperature side portion of the pulse tube is cooled by means of refrigerant flowing out of the pressure source, a free gas space between the changeover valve and the hot end of the cold reservoir does not increase. Moreover, the pulse tube refrigerator of the present invention accomplishes the effect of increasing the refrigerating capacity effectively.

In the pulse tube refrigerator of the sixth invention having the above-described construction according to the second invention, the cooling means cools the high-temperature-side portion on the wall of the pulse tube by use of refrigerant which flows out of the cold reservoir and flows into a pressure source. Therefore, in a pulse tube refrigerator of the sixth invention, the timing of cooling the high-temperature side of the pulse tube shifts by about 180° as compared with the above-described fourth invention. However, refrigerant flowing into the pressure source is lower in temperature than refrigerant flowing into the hot end of the cold reservoir, because refrigerant flowing out of the hot end of the cold reservoir flows into the pressure source. Therefore, the temperature of refrigerant which cools the high-temperature side wall portion of the pulse tube is low. Therefore, when the wall of the pulse tube is thick, the heat capacity of the pulse tube increases so that influence of the timing shift is mitigated by the heat accumulation effect of the wall. Moreover, the pulse tube refrigerator of the sixth invention accomplishes the effect of increasing the refrigerating capacity.

In the pulse tube refrigerator of the seventh invention having the above-described construction according to the second invention, the cooling means cools the high-temperature-side portion on the wall of the pulse tube by use of refrigerant which flows between the low-pressure outlet port of a changeover valve and a suction port of the pressure source. Therefore, the pulse tube refrigerator of the seventh invention is the same as that of the above-described sixth invention in terms of the action of cooling the high-temperature-side portion on the wall of the pulse tube and cooling the high-temperature side of the pulse tube via the wall. However, since cooling is performed by use of refrigerant which flows between the suction port of the pressure source and the low-pressure outlet port of the changeover valve, even when the high-temperature side of the pulse tube is cooled by refrigerant flowing to the suction port of the pressure source, the free gas space between the changeover valve and the hot end of the cold reservoir does not increase. Moreover, the pulse tube refrigerator of the seventh invention accomplishes the effect of increasing the refrigerating capacity effectively.

In the pulse tube refrigerator of the eighth invention having the above-described construction according to the second invention, the cooling means cools the high-temperature-side portion on the wall of the pulse tube by use of refrigerant from a compressor provided separately. Therefore, in the pulse tube refrigerator of the above-described eighth invention, pressure loss and temperature increase of the refrigerant, which would otherwise occur when the high-temperature-side portion on the wall of the pulse tube is cooled by used of refrigerant of the pressure source, do not occur, and thus the high-temperature side of the pulse tube can be cooled. Therefore, the pulse tube refrigerator achieves the effect of increasing the refrigerating capacity to the greatest extent.

In the pulse tube refrigerator of the ninth invention having the above-described construction according to the second invention, the cooling means cools a heat radiating unit disposed at the hot end of the pulse tube, by use of refrigerant which flows between a discharge side of a pressure source and a high-pressure inlet port of a changeover valve communicating with the discharge side of the pressure source. Therefore, the pulse tube refrigerator of the ninth invention is the same as that of the above-described fourth invention in terms of the action of cooling the high-temperature-side portion on the wall of the pulse tube and cooling the high-temperature side of the pulse tube through the wall. However, since cooling is performed by use of refrigerant which flows between the discharge port of the pressure source and the inflow side of the changeover valve, the heat radiating unit is cooled by use of refrigerant flowing from the discharge port of the pressure source, so that the free gas space between the changeover valve and the hot end of the cold reservoir does not increase. Moreover, the pulse tube refrigerator of the ninth invention accomplishes the effect of increasing the refrigerating capacity effectively.

In the pulse tube refrigerator of the tenth invention having the above-described construction according to the second invention, the cooling means cools a heat radiating unit disposed at the hot end of the pulse tube, by use of refrigerant which flows between a suction port of a pressure source and a low-pressure outlet port of a changeover valve communicating with the suction port or the pressure source. Therefore, in the pulse tube refrigerator of the above-described tenth invention, since cooling is performed by use of refrigerant which flows between the suction port of the pressure source and the outlet side of the changeover valve, the heat radiating unit is cooled by refrigerant flowing to the suction port of the pressure source, so that the free gas space between the changeover valve and the hot end of the cold reservoir does not increase. Moreover, the pulse tube refrigerator of the tenth invention accomplishes the effect of increasing the refrigerating capacity effectively.

In the pulse tube refrigerator of the eleventh invention having the above-described construction according to the second invention, the cooling means cools the high-temperature-side portion on the wall of the pulse tube by use of refrigerant flowing out of the low-pressure outlet port of the changeover valve; and the refrigerant used to cool the high-temperature-side portion on the wall of the pulse tube is cooled by use of the radiator provided between a suction port of a pressure source and a low-pressure outlet port of a changeover valve communicating with the suction port of the pressure source. Therefore, the pulse tube refrigerator of the present invention accomplishes the effect of increasing the refrigerating capacity effectively.

In the pulse tube refrigerator of the twelfth invention having the above-described construction according to the second invention, the cooling means cools a heat radiating unit disposed at the hot end of the pulse tube by use of refrigerant flowing out of the low-pressure outlet port of the changeover valve, and the refrigerant used to cool the heat radiating unit is cooled by use of the radiator provided between a suction port of a pressure source and a low-pressure outlet port of a changeover valve communicating with the suction port of the pressure source. Therefore, the pulse tube refrigerator of the present invention accomplishes the effect of increasing the refrigerating capacity effectively.

In the pulse tube refrigerator of the thirteenth invention having the above-described construction according to the third invention, the cooling means is constituted by a high-temperature-side portion on the wall of the pulse tube disposed in the atmosphere. Therefore, in the pulse tube refrigerator of the above-described thirteenth invention, since the wall temperature at the high-temperature side of the pulse tube decreases because of air cooling of the high-temperature-side portion on the wall of the pulse tube, the quantity of heat which reaches the cold end of the pulse tube due to heat conduction decreases, and refrigerant gas in contact with the inner wall surface of the high-temperature-side portion of the pulse tube is also cooled, whereby the quantity of heat which reaches the cold end of the pulse tube due to movement of the refrigerant gas also decreases. Moreover, the pulse tube refrigerator of the thirteenth invention accomplishes the effect of increasing the refrigerating capacity.

In the pulse tube refrigerator of the fourteenth invention having the above-described construction according to the thirteenth invention, fins are provided on an outer circumferential surface of the high-temperature-side portion on the wall of the pulse tube disposed in the atmosphere. Therefore, in the pulse tube refrigerator of the above-described fourteenth invention, the cooling area of the pulse tube is increased so as to increase the degree of cooling by air, whereby the temperature of the high-temperature-side wall portion of the pulse tube decreases. Moreover, the pulse tube refrigerator of the present invention accomplishes the effect of increasing the refrigerating capacity.

In the pulse tube refrigerator of the fifteenth invention having the above-described construction according to the thirteenth invention or the fourteenth invention, air is forcedly supplied to the high-temperature-side portion of the wall of the pulse tube. Therefore, in the pulse tube refrigerator of the above-described fifteenth invention, the heat transfer of air which cools the high-temperature-side wall portion of the pulse tube is improved so as to increase the degree of cooling by air, whereby the temperature of the high-temperature-side wall portion of the pulse tube decreases. Moreover, the pulse tube refrigerator of the fifteenth invention accomplishes the effect of increasing the refrigerating capacity.

In the pulse tube refrigerator of the sixteenth invention having the above-described construction according to the thirteenth invention, the high-temperature-side portion on the wall of the pulse tube disposed in the atmosphere is formed of a member having good heat conduction; a low-temperature-side portion on the wall of the pulse tube disposed within a vacuum tank is formed of a member having poor heat conduction; and the high-temperature-side portion and the low-temperature-side portion are joined together. Therefore, in the pulse tube refrigerator of the above-described sixteenth invention, since the heat conduction in the radial direction of the high-temperature-side tube portion of the pulse tube disposed in the atmosphere increases, the temperature difference between the inner circumferential surface and the outer circumferential surface of the high-temperature-side tube portion decreases, whereby the temperature of refrigerant in contact with the inner circumferential surface decreases, and accomplishes the effect of increasing the refrigerating capacity.

In the pulse tube refrigerator of the seventeenth invention having the above-described construction according to the thirteenth invention, one end of a conducting member is disposed in thermal contact with the high-temperature-side portion on the wall of the pulse tube, and the other end of the conducting member is disposed in thermal contact with a cooling source which is lower in temperature than the high-temperature-side portion on the wall of the pulse tube. Therefore, the high-temperature-side wall portion of the pulse tube is cooled by heat conduct, and the pulse tube refrigerator of the present invention accomplishes the effect of increasing the refrigerating capacity.

In the pulse tube refrigerator of the eighteenth invention having the above-described construction according to the sixteenth invention, the cooling source is formed of a vacuum tank of the refrigerator. Therefore, in the pulse tube refrigerator of the above-described eighteenth invention, heat which moves from the high-temperature-side portion of the pulse tube to the vacuum chamber via the conducting member is radiated to the atmosphere at the outer circumferential surface of the vacuum tank, whereby the high-temperature-side wall portion of the pulse tube is cooled. Moreover, the pulse tube refrigerator of the present invention accomplishes the effect of increasing the refrigerating capacity.

BEST MODE FOR CARRYING OUT THE INVENTION

Embodiments of the present invention will now be described with reference to the drawings.

(First Embodiment)

Figure 1:
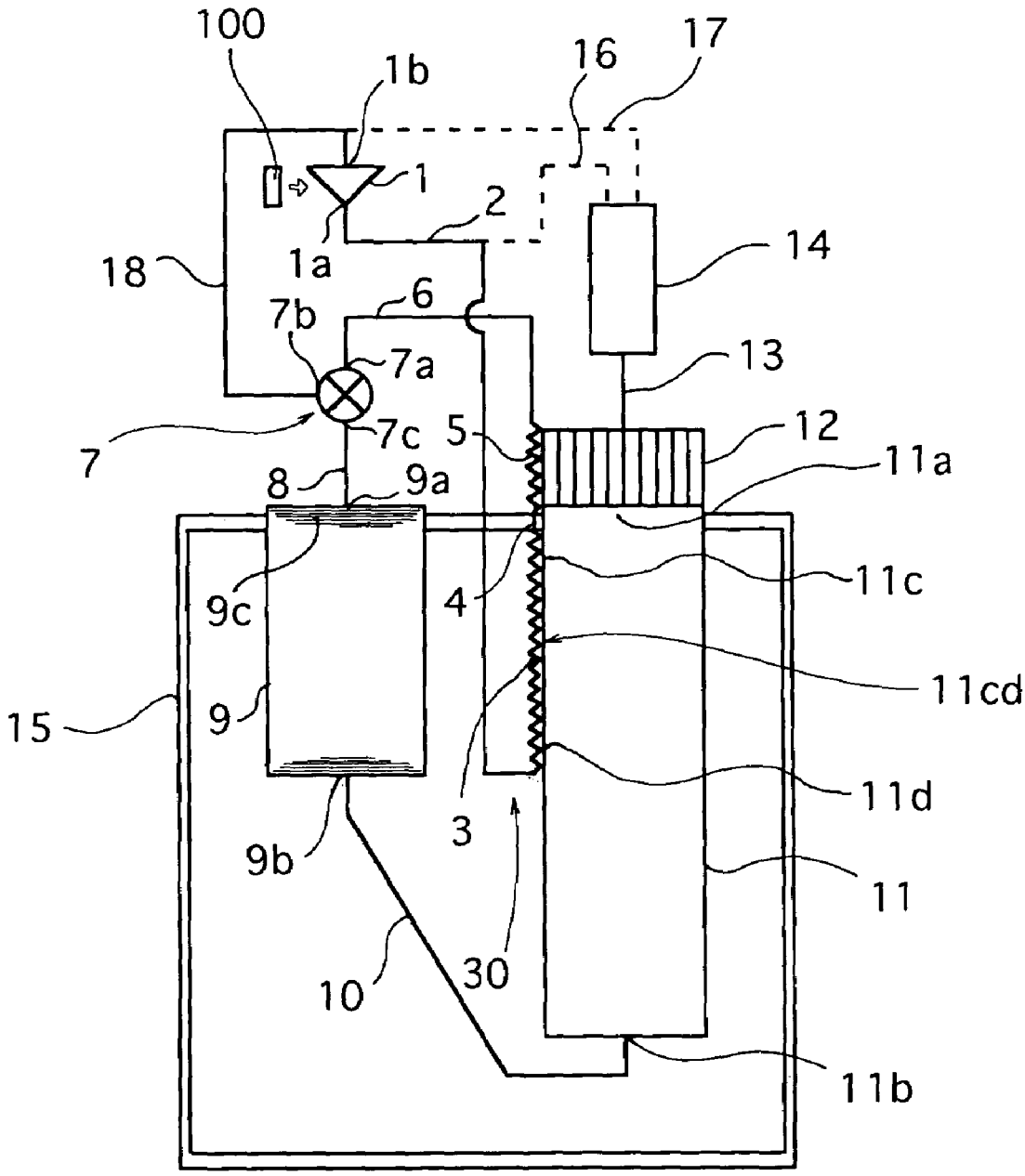
FIG. 1 is a circuit diagram showing the pulse tube refrigerator of the first embodiment according to the present invention.

As shown in FIG. 1, a pulse tube refrigerator according to a first embodiment includes a pulse tube 11, which is connected to a cold reservoir 9, and has a hot end 11*a* that generates heat. Cooling means 30 is provided so as to cool a high-temperature-side wall portion 11*cd* of the pulse tube by means of cooling medium having a temperature lower than a high-temperature-side wall temperature of the pulse tube. Specifically, the high-temperature-side wall portion 11*cd* of the pulse tube is cooled by means of refrigerant, flowing out of a pressure source 1 of the pulse tube refrigerator and flowing into the cold reservoir 9.

In the first embodiment, which belongs to the second, fourth, fifth, ninth, and tenth inventions, a discharge port 1*a* of the pressure source 1 communicates with a high-pressure inlet port 7*a* of a changeover valve 7 via a flow passage 2, a flow passage 3, a flow passage 4, a flow passage 5, and a flow passage 6, in this sequence. A suction port 1*b* of the pressure source 1 is connected to a low-pressure outlet port 7*b* of the changeover valve 7 via a flow passage 18.

As shown in FIG. 1, the flow passage 3, which partially constitutes the cooling means 30, is disposed in contact with an outer surface of the high-temperature-side wall portion 11*cd* of the pulse tube so as to establish thermal contact with and cool the high-temperature-side wall portion 11*cd*, the high-temperature-side wall portion extending from a point 11*d* at which the temperature of the pulse tube 11 is higher than atmospheric temperature to a point 11*c* near the hot end of the pulse tube 11.

The flow passage 5, which partially constitutes the cooling means 30, is disposed in contact with an outer surface of a heat radiating unit 12 disposed at the hot end 11*a* of the pulse tube 11, in such a manner that the flow passage 5 establishes thermal contract with the outer circumferential surface of the heat radiating unit 12 and thus exchanges heat with refrigerant flowing within the heat radiating unit 12.

The changeover valve 7 is controlled to be switched in such a manner that a port 7*c* of the changeover valve 7 communicates with the high-pressure inlet port 7*a* when refrigerant flows from the pressure source 1 to the cold reservoir 9, and communicates with the low-pressure outlet port 7*b* when refrigerant flows from the cold reservoir 9 to the pressure source 1.

The cold reservoir 9 is filled with a cold-reserving material 9*c* such as wire gauze. The port 7*c* communicates with a hot end 9*a* of the cold reservoir 9 via a flow passage 8. A cold end 9*b* of the cold reservoir 9 communicates with a cold end 11*b* of the pulse tube 11 via a flow passage 10.

The hot end 11*a* of the pulse tube 11 communicates with a phase adjuster 14 via the heat radiating unit 12 and a flow passage 13. Reference numeral 15 denotes a vacuum tank, the interior of which is maintained at vacuum. The pulse tube refrigerator is configured in the above-described manner.

Refrigerant compressed at the pressure source 1 is cooled by means of a compressor cooler 100.

Figure 6:
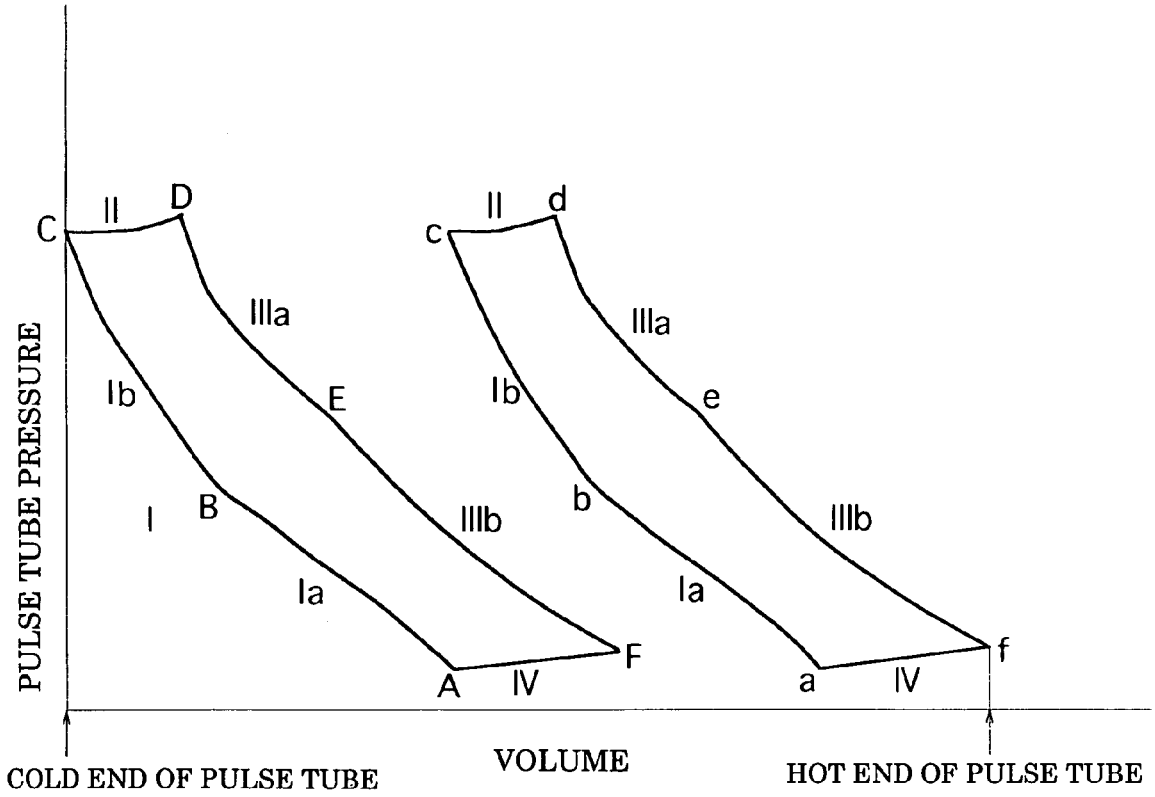
FIG. 6 is PV diagrams at the low temperature and high-temperature sides, respectively, of the pulse tube according to the embodiment of the present invention.

FIG. 6 shows PV diagrams at the low temperature and high-temperature sides, respectively, of the pulse tube according to the first embodiment.

Operation of the pulse tube refrigerator of the first embodiment having the above-described construction will now be described.

(Compression Step I)

In a compression step Ia (FIG. 6) in which the port 7*c* of the changeover valve 7 communicates with neither the high-pressure inlet port 7*a* nor the low-pressure outlet port 7*b*, refrigerant flows from the phase adjuster 14 to the hot end 11*a* of the pulse tube 11 via the flow passage 13 and the heat radiating unit 12, whereby the pressure within the pulse tube 11 increases from a low pressure to an intermediate pressure, and the temperature of refrigerant increases.

In a compression step Ib (FIG. 6) in which the port 7*c* of the changeover valve 7 communicates with the high-pressure inlet port 7*a*, refrigerant flowing out of the high pressure port 1*a* of the pressure source 1 flows into the cold end 11*b* of the pulse tube 11 via the flow passage 2, the flow passage 3, the flow passage 4, the flow passage 5, the flow passage 6, the changeover valve 7, the cold reservoir 9, and the flow passage 10, in this sequence. Meanwhile, refrigerant flowing out of the phase adjuster 14 flows into the hot end 11*a* of the pulse tube 11 via the flow passage 13 and the heat radiating unit 12. As a result, refrigerant within the pulse tube 11 is compressed from the almost intermediate pressure to a substantially high pressure, and the temperature of refrigerant within the pulse tube 11 further increases. The compression step Ia and the compression step Ib constitute the compression step I.

(Substantially-Isobaric Step II)

In a substantially-isobaric step II (FIG. 6), which follows the compression step I and in which the port 7*c* of the changeover valve 7 communicates with the high-pressure inlet port 7*a*, refrigerant flows from the pressure source 1 to the cold end 11*b* of the pulse tube 11, while passing through the changeover valve 7, the cold reservoir9, and the flow passage 10. Meanwhile, refrigerant flows from the hot end 11*a* of the pulse tube 11 to the phase adjuster via the heat radiating unit 12 and the flow passage 13. As a result, the pressure of refrigerant becomes slightly higher than that at the end of the compression step I, and the temperature of refrigerant becomes slightly higher than that at the end of the compression step I.

(Expansion Step III)

In an expansion step IIIa (FIG. 6) in which the port 7*c* of the changeover valve 7 communicates with neither the high-pressure inlet port 7*a* nor the low-pressure outlet port 7*b*, a portion of refrigerant within the pulse tube 11 flows outs through the hot end 11*a* thereof to the phase adjuster 14 via the heat radiating unit 12 and the flow passage 13, whereby the pressure of refrigerant decreases to an intermediate pressure, and the temperature of refrigerant within the pulse tube 11 decreases.

In an expansion step IIIb (FIG. 6) in which the port 7*c* of the changeover valve 7 communicates with the low-pressure outlet port 7*b*, refrigerant flows from the cold end of the pulse tube to the low-pressure side of the pressure source 1 via the flow passage 10, the cold reservoir 9, the changeover valve 7, and the flow passage 8. Meanwhile, refrigerant flows from the hot end 11*a* of the pulse tube 11 into the phase adjuster 14 via the heat radiating unit 12 and the flow passage 13. As a result, the pressure of refrigerant decreases from the substantially intermediate pressure to an almost low pressure, and the temperature of refrigerant within the pulse tube 11 further decreases. The expansion step IIIa and the expansion step IIIb constitute the expansion step III.

(Substantially-Isobaric Step IV)

In a substantially-isobaric step IV, which follows the expansion step III and in which the port 7*c* of the changeover valve 7 communicates with the low-pressure output port 7*b*, low-pressure refrigerant flows from the cold end 11*b* of the pulse tube 11 to the suction side of the pressure source 1 via the flow passage 10, the cold reservoir 9, the flow passage 8, the changeover valve 7, and the flow passage 8. Meanwhile, low-pressure refrigerant flows from the hot end 11*a* of the pulse tube 11 into the phase adjuster 14 via the heat radiating unit 12 and the flow passage 13. As a result, the pressure of refrigerant becomes slightly lower than that at the end of the expansion step III, and the temperature of refrigerant within the pulse tube 11 becomes slightly lower than that at the end of the expansion step III.

In the above-described substantially-isobaric step II and expansion step III, refrigerant within the pulse tube 11 performs work (L1) and in the above-described substantially-isobaric step IV and compression step I, refrigerant within the pulse tube 11 receives work (L2). The difference between the work (L1) and the work (L2) is equal to a refrigerating quantity (Qi) generated at the low-temperature side of the pulse tube 11.

Refrigerant flowing through the flow passage 3 cools the high-temperature-side wall portion 11*cd* of the pulse tube 11, and the high-temperature-side wall portion 11*cd* captures heat from a portion of refrigerant in contact with the inner surface of the high-temperature-side wall portion 11*cdb* to thereby lower the temperature of the refrigerant.

As a result, heat loss attributable to conduction of heat to the lower temperature side of the pulse tube 11 via the wall thereof and heat loss attributable to transfer of heat to the lower temperature side of the pulse tube 11 by means of refrigerant that flows back and forth in the vicinity of the inner surface of the pulse tube 11 both decrease, whereby the amount of heat which lowers the refrigerating quantity Qi generated at the low-temperature side of the pulse tube 11 decreases, the usable refrigerating quantity increases, and the refrigerating capacity of the pulse tube refrigerator increases.

The above-described refrigerant flowing into the pulse tube 11 from the low-temperature side thereof flows through the hot end 11*a* thereof to the phase adjuster 14 via the heat radiating unit 12 and the flow passage 13. Such refrigerant is cooled when passing through the heat radiating unit 12 by refrigerant which flows through the flow passage 5. Since the flow passage 5 is disposed between the changeover valve 7 and the pressure source 1, the free gas spaces of the flow passage 8, the cold reservoir 9, the flow passage 10, the pulse tube 11, the heat radiating unit 12, and the flow passage 13 do not increase, and the decrease in refrigerating capacity is small.

(Second Embodiment)

Figure 2:
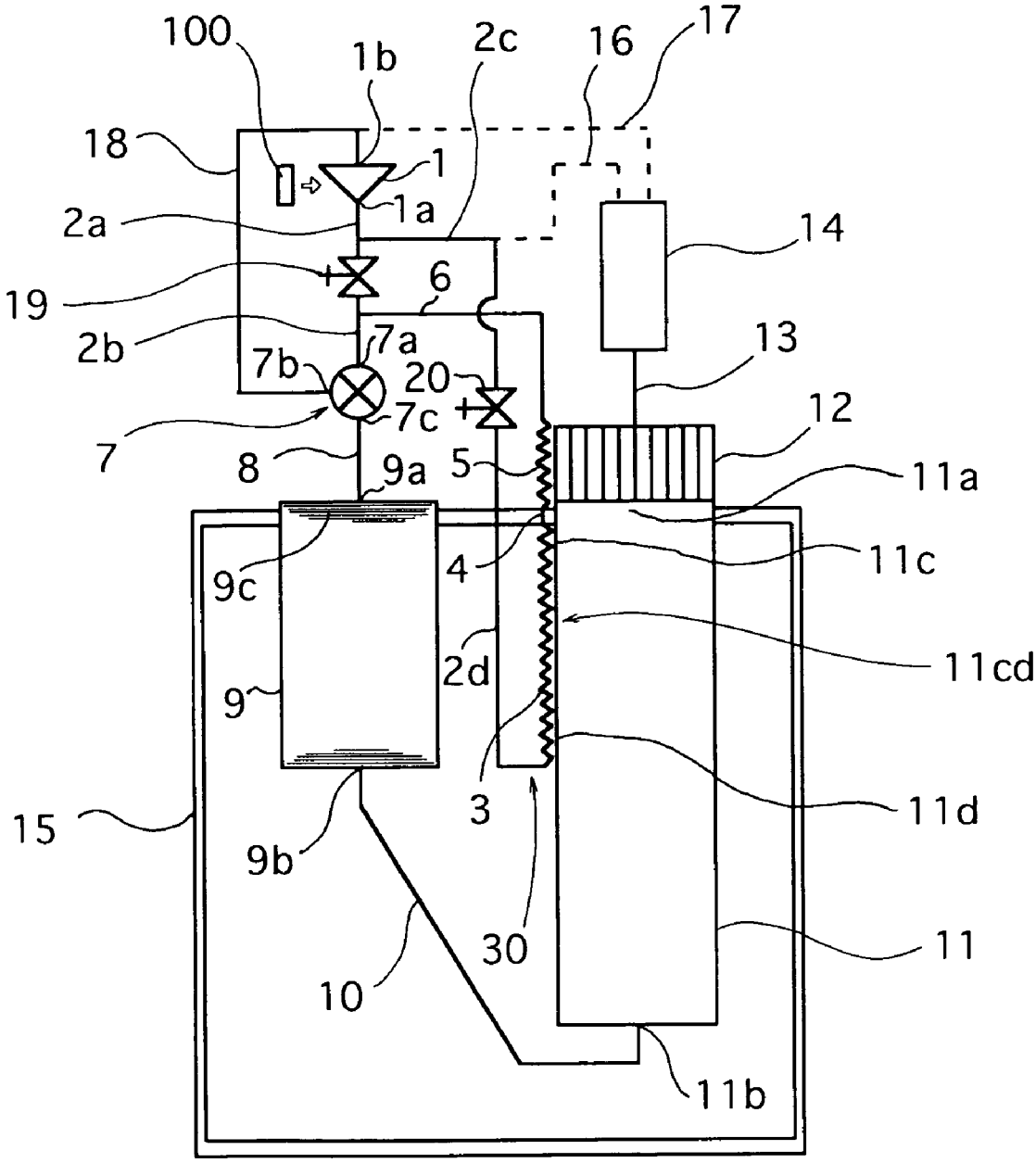
FIG. 2 is a circuit diagram showing the pulse tube refrigerator of the second embodiment according to the present invention.

As shown in FIG. 2, a pulse tube refrigerator according to a second embodiment, which is another embodiment belonging to the second, fourth, fifth, ninth, and tenth inventions, differs from that of the first embodiment shown in FIG. 1 in that the circuit between the discharge port 1*a* of the pressure source 1 and the high-pressure inlet port 7*a* of the changeover valve 7 consists of a main circuit and a branch circuit.

The main circuit extends from the discharge port 1*a* of the pressure source 1 to the high-pressure inlet port 7*a* of the changeover valve 7 via a flow passage 2*a*, a flow-rate adjustment valve 19, and a flow passage 2*b*. The branch circuit branches off from the flow passage 2*a*, and merges into the flow passage 2*b* after extending through a flow passage 2*c*, a flow-rate adjustment valve 20, a flow passage 2*d*, the flow passage 3, the flow passage 4, the flow passage 5, and the flow passage 6. The flow passage 3 and the flow passage 5 are in thermal contact with the outer surface of the high-temperature-side wall portion 11*cd* of the pulse tube 11 and the outer circumference surface of the heat radiating unit 12.

The flow-rate adjustment valves 19 and 20 are provided in order to adjust the flow rate of refrigerant flowing through the branch circuit. One or both of the flow-rate adjustment valves 19 and 20 may be omitted, depending on the flow resistances of the flow passage 2*c*, the flow passage 2*d*, the flow passage 3, the flow passage 4, the flow passage 5, and the flow passage 6. The configuration of the remaining portion is identical with that of the first embodiment shown in FIG. 1.

Operation of the pulse tube refrigerator according to the second embodiment having the above-described construction is identical with that of the first embodiment in terms of cooling of the pulse tube 11 and cooling of the heat radiating unit 12. When the flow rate of refrigerant flowing through the cold reservoir 12 is high or when the flow resistances of the flow passage 3 and the flow passage 5 are large, the pressure losses at the flow passage 3 and the flow passage 5 can be reduced. Therefore, the pulse tube refrigerator has an advantage in that a drop in refrigerating capacity attributable to pressure loss is small.

(Third Embodiment)

Figure 3:
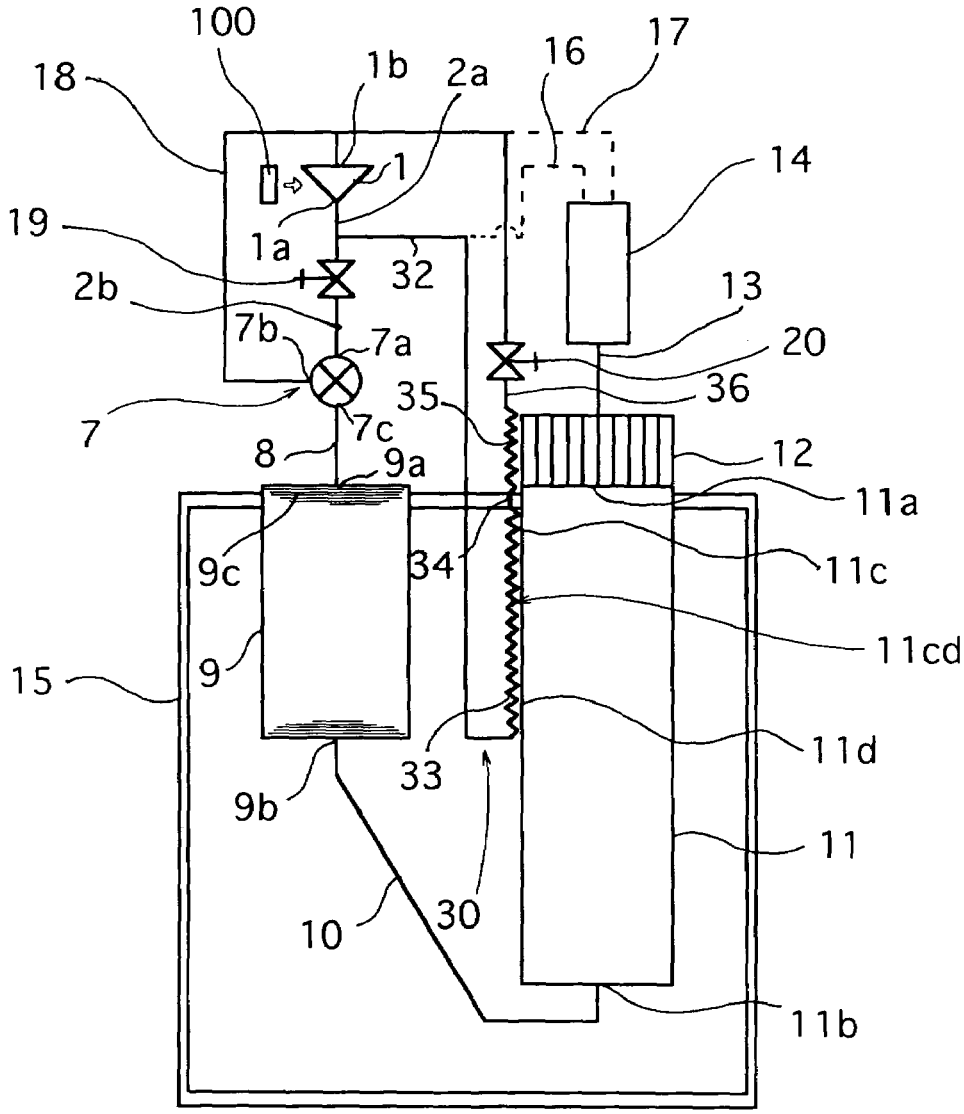
FIG. 3 is a circuit diagram showing the pulse tube refrigerator of the third embodiment according to the present invention.

As shown in FIG. 3, in a pulse tube refrigerator according to a third embodiment, which belongs to the second invention, a portion of refrigerant flowing out from the discharge port 1*a* of the pressure source 1 cools the high-temperature-side wall portion 11*cd* of the pulse tube 11 and the heat radiating unit 12, and then returns to the suction port 1*b* of the pressure source 1, without flowing into the cold reservoir 9.

Specifically, the discharge port 1*a* of the pressure source 1 communicates with the high-pressure inlet port 7*a* of the changeover valve 7 via the flow passage 2*a*, the flow-rate adjustment valve 19, and the flow passage 2*b*. A flow passage 32 divided from the flow passage 2*a* communicates with the suction port 1*b* of the pressure source 1 via a flow passage 33, a flow passage 34, a flow passage 35, a flow passage 36, the flow-rate adjustment valve 20, and a flow passage 37. The flow passage 33 and the flow passage 35 are in thermal contact with the outer surface of the high-temperature-side wall portion 11*cd* of the pulse tube 11 and the outer circumference surface of the heat radiating unit 12, respectively.

The flow-rate adjustment valves 19 and 20 are provided in order to adjust the flow rate of refrigerant flowing through the flow passage 2*a* and the flow passage 32. Either or both of the flow-rate adjustment valves 19 and 20 may be omitted, depending on the flow resistances of the flow passage 32, the flow passage 33, the flow passage 34, the flow passage 35, the flow passage 36, and the flow passage 37. The configuration of the remaining portion is identical with that of the first embodiment.

In the third embodiment, a portion of refrigerant flowing out from the discharge port 1*a* of the pressure source 1 continuously flows through the flow passages 33 and 35, whereby the high-temperature-side wall portion 11*cd* of the pulse tube 11 and the heat radiating unit 12 are cooled continuously in all the steps (the compression step I, the substantially-isobaric step II, the expansion step III, and the substantially-isobaric step IV) of the pulse tube refrigerator cycle. Therefore, the refrigerator of the third embodiment has a greater refrigerating capacity as compared with that of the first embodiment, although the flow rate of the pressure source 1 increases.

(Fourth Embodiment)

Figure 4:
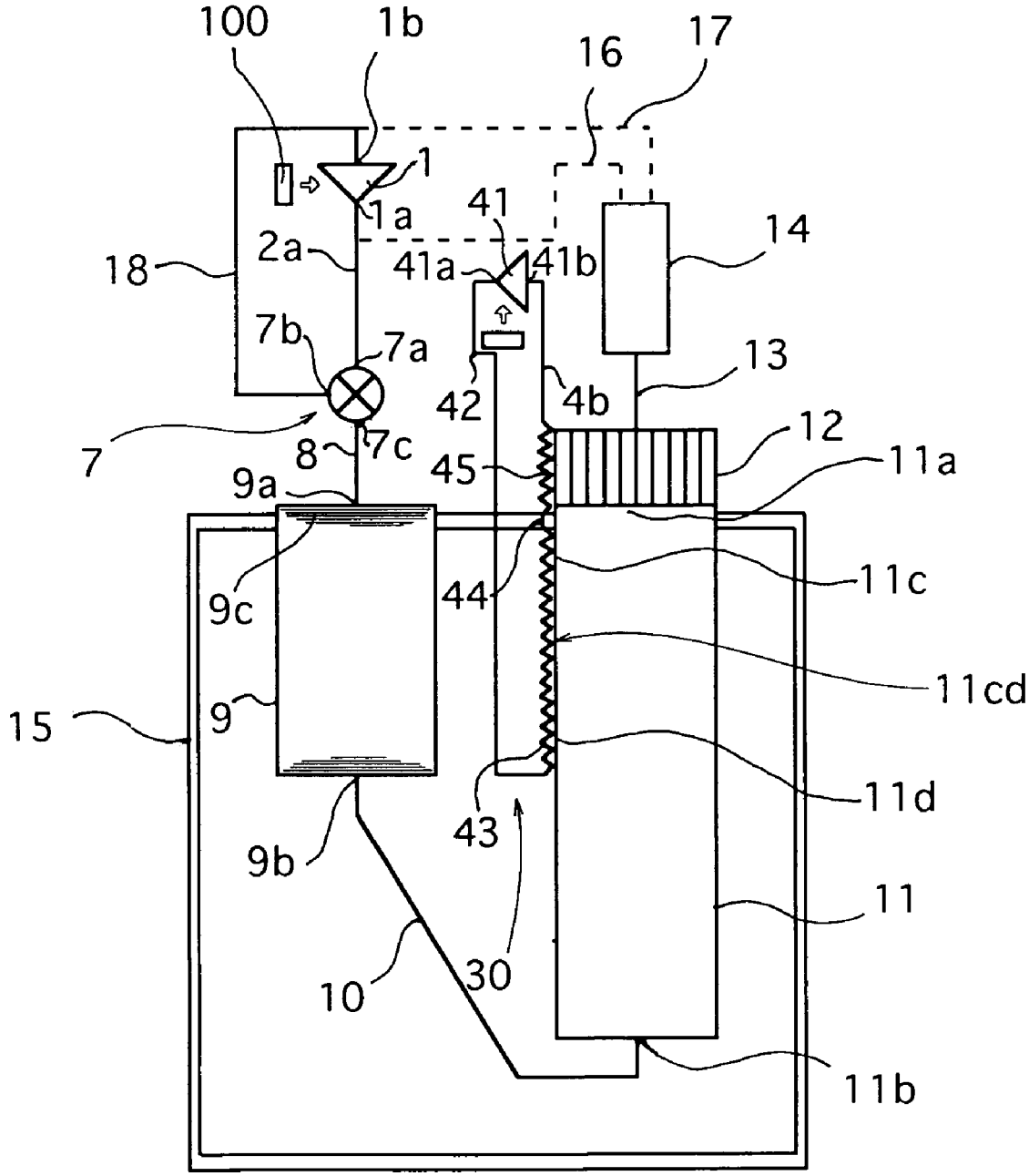
FIG. 4 is a circuit diagram showing the pulse tube refrigerator of the fourth embodiment according to the present invention.

As shown in FIG. 4, a pulse tube refrigerator according to a fourth embodiment, which belongs to the eighth invention, is characterized in that the high-temperature-side wall portion 11*cd* of the pulse tube 11 and the heat radiating unit 12 are cooled by means of refrigerant flowing from a discharge port 41*a* of a pressure source 41 differing from the pressure source 1.

Specifically, the discharge port 41*a* of the pressure source 41 communicates with a suction port 41*b* of the pressure source 41 via a flow passage 42, a flow passage 43, a flow passage 44, a flow passage 45, and a flow passage 46. The flow passage 43 and the flow passage 45 are in thermal contact with the high-temperature-side wall portion 11*cd* of the pulse tube 11 and the heat radiating unit 12, respectively.

The discharge port 1*a* of the pressure source 1 communicates with the high-pressure inlet port 7*a* of the changeover valve 7 via the flow passage 2*a*. The configuration of the remaining portion is identical with that of the first embodiment shown in FIG. 1.

In the fourth embodiment, refrigerant flowing out from the discharge port 41*a* of the pressure source 41 continuously flows through the flow passages 43 and 45, whereby the high-temperature-side wall portion 11*cd* of the pulse tube 11 is cooled continuously in all the steps (the compression step I, the substantially-isobaric step II, the expansion step III, and the substantially-isobaric step IV) of the pulse tube refrigerator cycle. Therefore, the refrigerator of the present embodiment has a greater refrigerating capacity at the low-temperature side of the pulse tube, as compared with that of the first embodiment, although the pressure source 41 must be newly provided.

(Fifth Embodiment)

Figure 5:
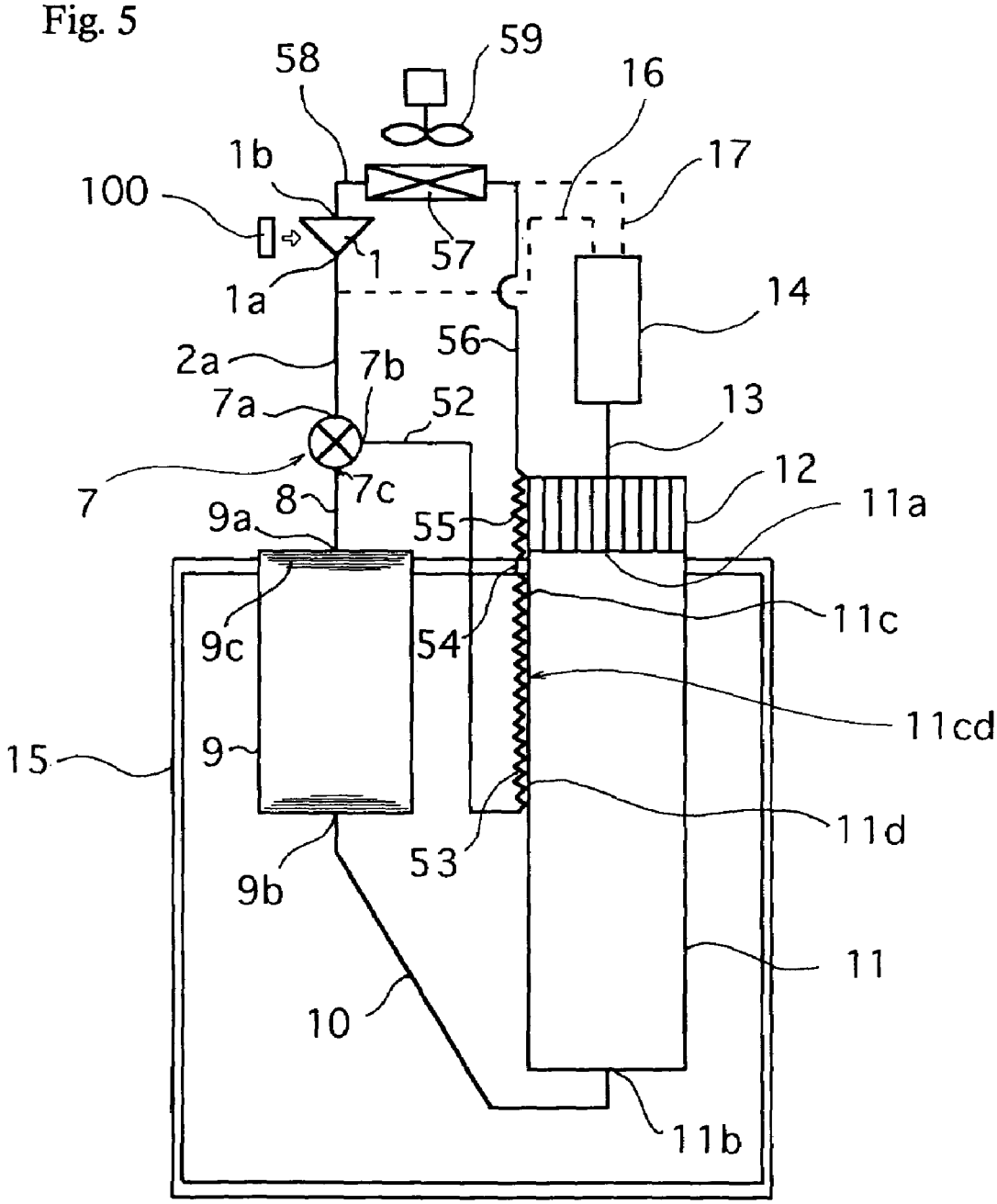
FIG. 5 is a circuit diagram showing the pulse tube refrigerator of the fifth embodiment according to the present invention.

As shown in FIG. 5, a pulse tube refrigerator according to a fifth embodiment, which belongs to the sixth, seventh, eleventh, and eleventh inventions, is characterized in that cooling is performed by means of refrigerant flowing between the low-pressure output port 7*b* of the changeover valve 7 and the suction port 1*b* of the pressure source 1.

Specifically, the low-pressure output port 7*b* of the changeover valve 7 communicates with the suction port 1*b* of the pressure source 1 via a flow passage 52, a flow passage 53, a flow passage 54, a flow passage 55, a flow passage 56, a radiator 57 which is air-cooled by a fan 59, and a flow passage 58. The flow passage 53 and the flow passage 55 are in thermal contact with the high-temperature-side wall portion 11*cd* of the pulse tube 11 and the heat radiating unit 12, respectively.

The discharge port 1*a* of the pressure source 1 communicates with the high-pressure inlet port 7*a* of the changeover valve 7 via the flow passage 2*a*. The configuration of the remaining portion is identical with that of the first embodiment.

In the fifth embodiment, refrigerant flows from the cold reservoir 9 into the flow passage 53 via the low-pressure outlet port 7*b* of the changeover valve 7 and the flow passage 52, and cools the high-temperature-side wall portion 11*cd* of the pulse tube 11 at the flow passage 53. Subsequently, the refrigerant flows into the flow passage 55 via the flow passage 54 and cools refrigerant flowing between the phase adjuster 14 and the pulse tube 11 in the heat radiating unit 12. As a result, heat loss attributable to conduction of heat to the low-temperature side of the pulse tube 11 via the wall thereof and heat loss attributable to transfer of heat to the low-temperature side of the pulse tube 11 by means of refrigerant that flows back and forth in the vicinity of the inner surface of the pulse tube both decrease, whereby the refrigerating capacity of the refrigerator increases.

The timing of cooling the high-temperature side of the pulse tube shifts by about 180° as compared with the above-described fifth invention. However, refrigerant flowing into the pressure source is lower in temperature than refrigerant flowing into the hot end of the cold reservoir, because refrigerant flowing out of the hot end of the cold reservoir flows. Therefore, the temperature of refrigerant which cools the high-temperature side of the pulse tube is low.

In this case, in terms of timing of cooling the high-temperature side of the pulse tube, the embodiment of the fifth invention is superior, because in the present embodiment, the timing of cooling the high-temperature side of the pulse tube shifts by about 180° as compared with the fifth invention. However, when the wall of the pulse tube 11 is thick, the heat capacity increases, so that influence of the timing shift is mitigated by the heat accumulation effect of the wall, whereby refrigerating capacity is enhanced.

(Sixth Embodiment)

Figure 7:
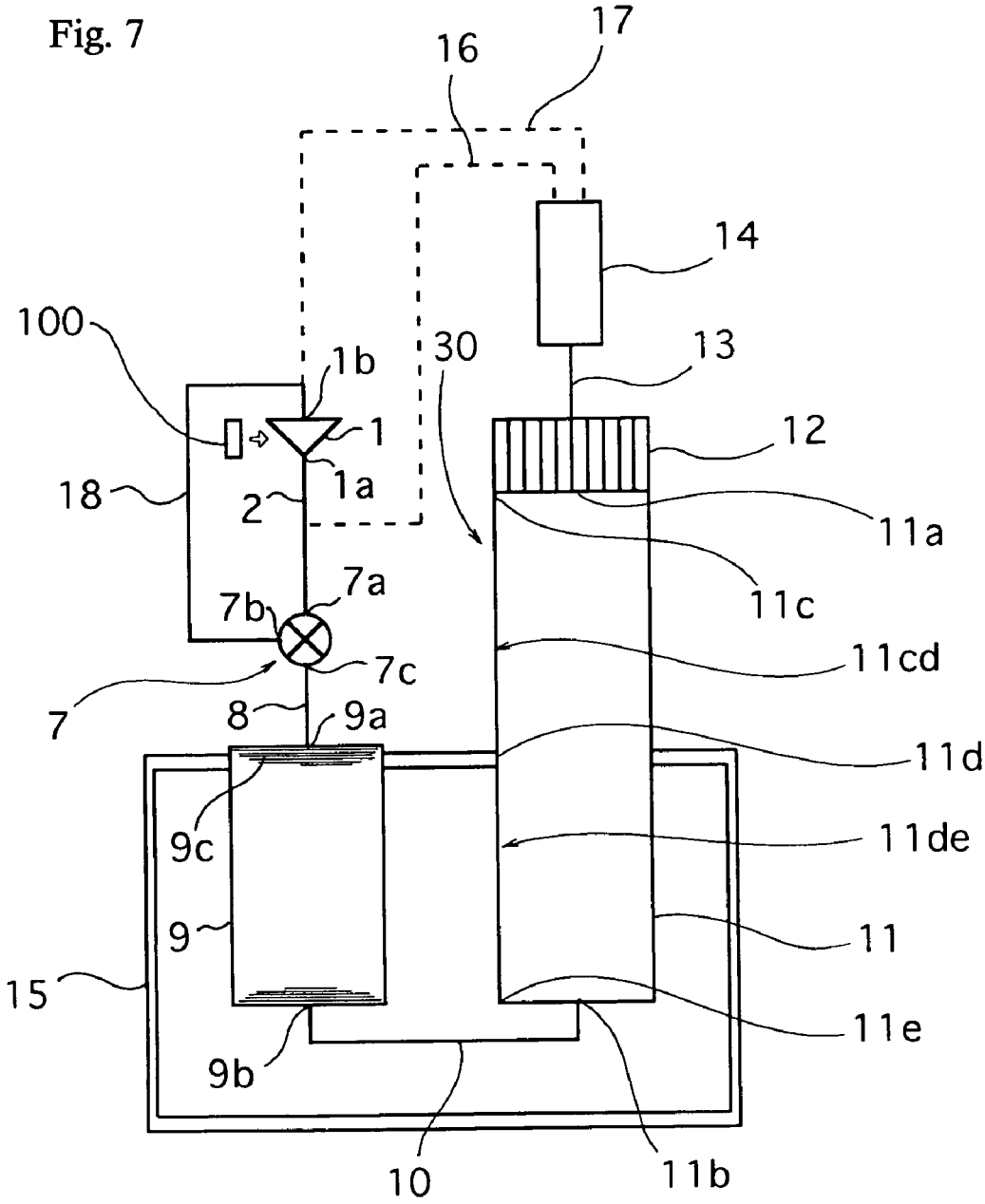
FIG. 7 is a circuit diagram showing the pulse tube refrigerator of the sixth embodiment according to the present invention.

As shown in FIG. 7, a pulse tube refrigerator according to a sixth embodiment is a type in which the pulse tube 11 is connected to the cold reservoir 9 and has a hot end 11*a* that generates heat, wherein the cooling means 30 which cools a high-temperature-side wall portion of the pulse tube by means of cooling medium having a temperature lower than a high-temperature-side wall temperature of the pulse tube is constituted by the high-temperature-side wall portion 11*ed* of the pulse tube provided in the atmosphere.

The discharge port 1*a* of the pressure source 1 communicates with the high-pressure inlet port 7*a* of the changeover valve 7 via the flow passage 2. The suction port 1*b* of the pressure source 1 communicates with the low-pressure outlet port 7*b* of the changeover valve 7 via the flow passage 18. The changeover valve 7 is controlled in such a manner that the port 7*c* of the changeover valve 7 communicates with the high-pressure inlet port 7*a* when refrigerant flows from the pressure source 1 to the cold reservoir 9, and communicates with the low-pressure outlet port 7*b* when refrigerant flows from the cold reservoir 9 to the pressure source 1.

The cold reservoir 9 is filled with a cold-reserving material 9*c* such as wire gauze. The port 7*c* communicates with the hot end 9*a* of the cold reservoir 9 via the flow passage 8. The cold end 9*b* of the cold reservoir 9 communicates with the cold end 11*b* of the pulse tube 11 via the flow passage 10. The hot end 11*a* of the pulse tube 11 communicates with the phase adjuster 14 via the heat radiating unit 12 and the flow passage 13.

The high-temperature side 11*cd* of the pulse tube 11, which constitutes the cooling means 30, is disposed in the atmosphere outside the vacuum tank 15, and the low-temperature side 11*de* is disposed within the vacuum tank 15. The interior of the vacuum tank 15 is maintained at vacuum.

Refrigerant compressed at the pressure source 1 is cooled by means of a compressor cooler 100. The PV diagrams at the low temperature and high-temperature sides, respectively, of the pulse tube according to the sixth embodiment having the above-described configuration are the same as those of the first embodiment shown in FIG. 6.

Operation of the pulse tube refrigerator according to the sixth embodiment having the above-described configuration is similar to that of the first embodiment.

Since the temperature of the high-temperature-side wall portion 11*cd* of the pulse tube 11 is higher than the temperature of surrounding air, the high-temperature-side wall portion 11*cd* of the pulse tube is cooled by the surrounding air, whereby the high-temperature-side wall portion 11*cd* captures heat from a portion of refrigerant in contact with the inner surface thereof to thereby lower the temperature of the refrigerant. As a result, heat loss attributable to conduction of heat to the low-temperature side of the pulse tube 11 via the wall thereof and heat loss attributable to transfer of heat to the low-temperature side of the pulse tube 11 by means of refrigerant that flows back and forth in the vicinity of the inner surface of the pulse tube 11 both decrease, whereby the amount of heat which lowers the refrigerating quantity Qi generated at the low-temperature side of the pulse tube decreases, whereby the usable refrigerating quantity increases, and the refrigerating capacity of the pulse tube refrigerator increases.

(Seventh Embodiment)

Figure 8:
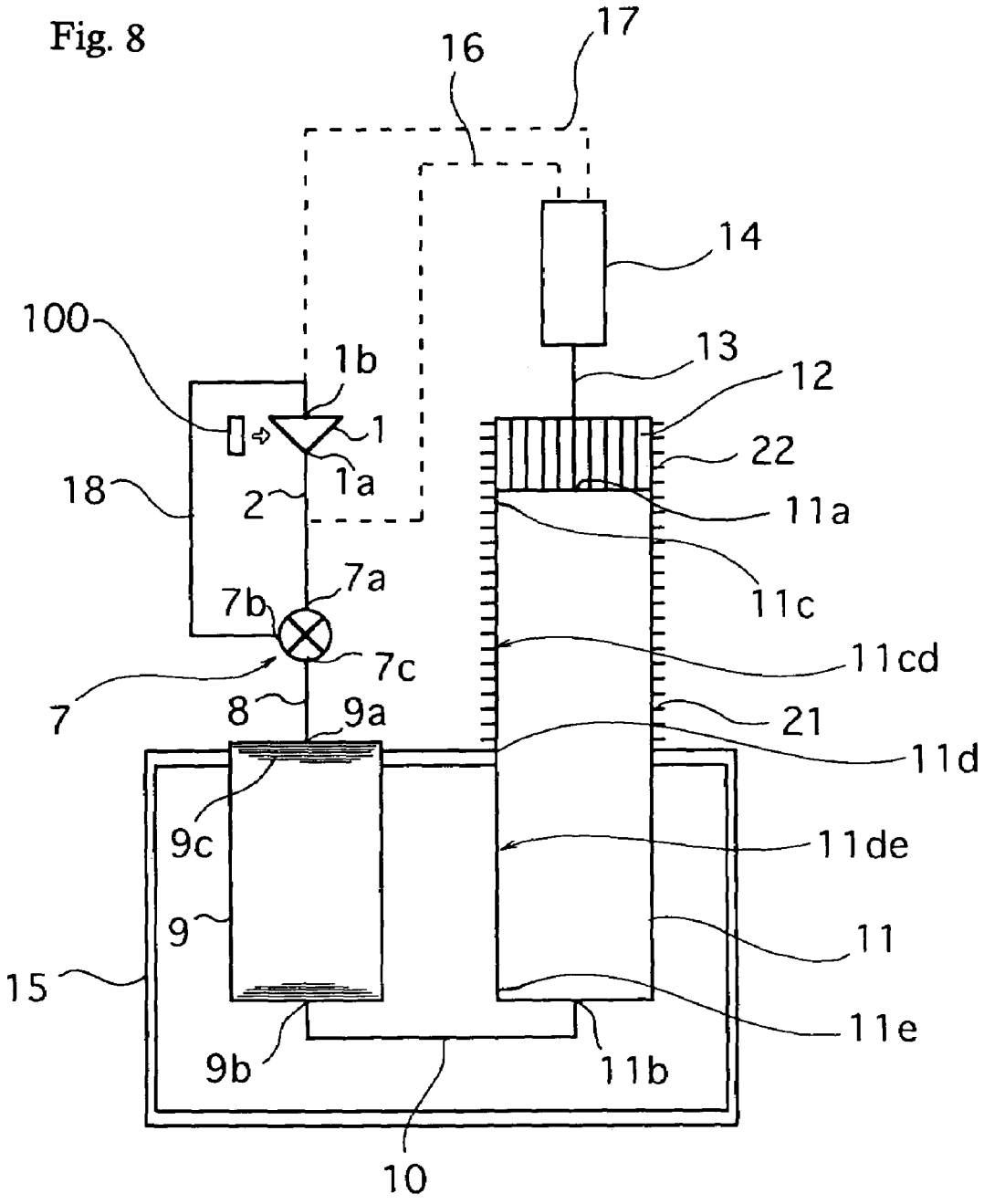
FIG. 8 is a circuit diagram showing the pulse tube refrigerator of the seventh embodiment according to the present invention.

As shown in FIG. 8, a pulse tube refrigerator according to a seventh embodiment is characterized in that a large number of annular fins 21 and 22 are provided on the high-temperature-side wall portion 11*cd* of the pulse tube 11 provided in the atmosphere outside the vacuum tank 15 and on the heat radiating unit 12, respectively.

The large number of annular fins 21 and 22 are arranged on the outer circumferential surfaces of the pulse tube 11 and the heat radiating unit 12 at constant intervals along the axial direction, as shown in FIG. 8.

By virtue of provision of the fins 21 and 22, the pulse tube refrigerator according to the seventh embodiment has an increased conduction surface, whereby cooling of the high-temperature-side wall portion 11*cd* of the pulse tube 11 and the heat radiating unit 12 can be performed better than in the sixth embodiment shown in FIG. 7. As a result, the refrigerating quantity increases, as compared with the sixth embodiment.

In the seventh embodiment, a large number of the fins 21 and 22 are fixed to the outer circumferential surface of the high-temperature-side wall portion 11*cd* of the pulse tube 11 and the outer circumferential surface of the heat radiating unit 12 at proper intervals. However, a fin may be provided spirally on the outer circumferential surface of the high-temperature-side wall portion 11*cd* of the pulse tube 11 and the outer circumferential surface of the heat radiating unit 12.

(Eighth Embodiment)

Figure 9:
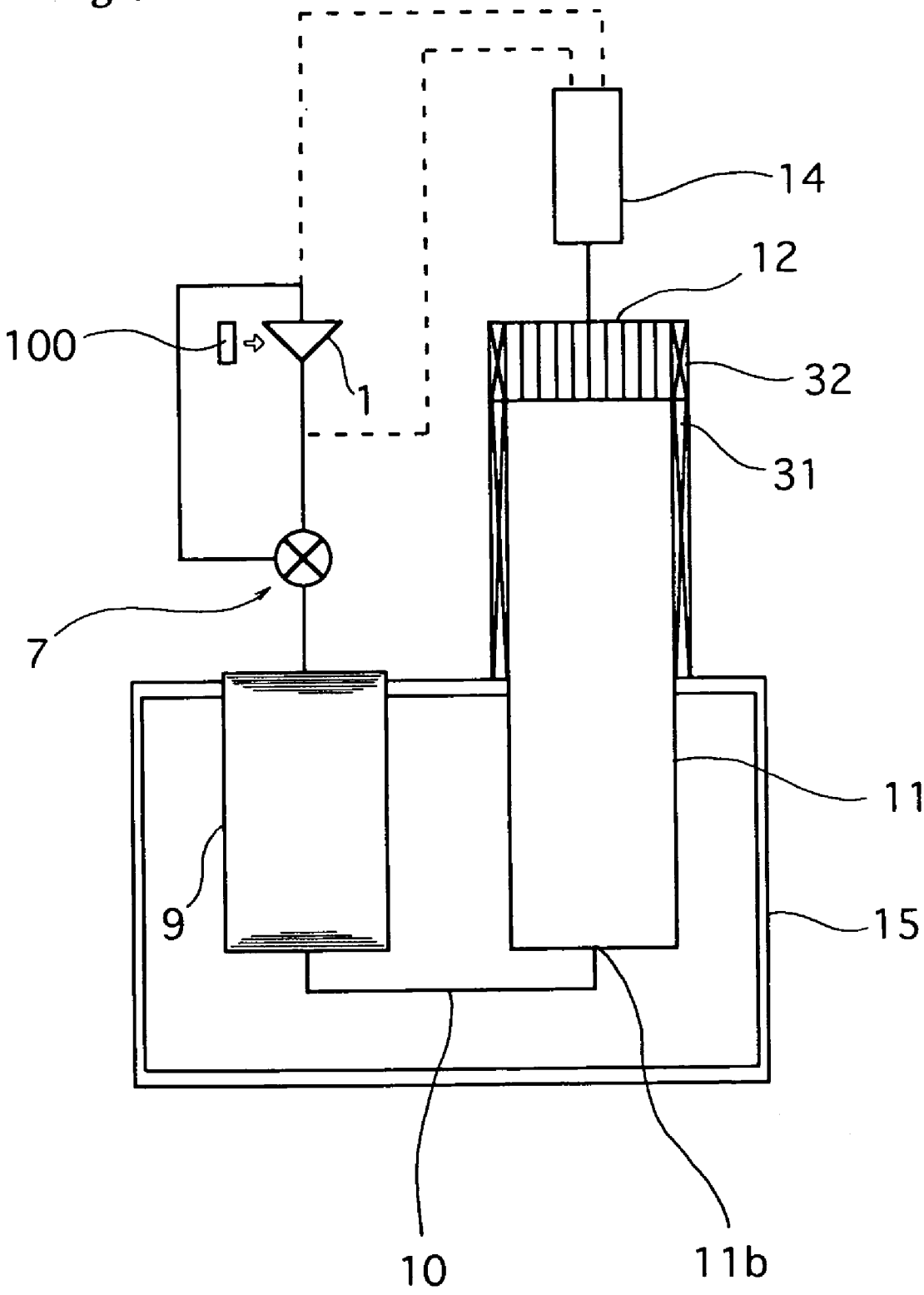
FIG. 9 is a circuit diagram showing the pulse tube refrigerator of the eighth embodiment according to the present invention.

As shown in FIG. 9, a pulse tube refrigerator according to an eighth embodiment is characterized in that a large number of vertical fins 31 and 32 are provided on the high-temperature-side wall portion 11*cd* of the pulse tube 11 provided in the atmosphere outside the vacuum tank 15 and on the heat radiating unit 12, respectively.

The large number of vertical fins 31 and 32 are arranged on the outer circumferential surfaces of the pulse tube 11 and the heat radiating unit 12 at constant intervals along the circumferential direction, in such a manner that the fins 31 and 32 extend over the entire lengths of the pulse tube 11 and the heat radiating unit 12, as shown in FIG. 9.

By virtue of provision of the fins 31 and 32, as in the case of the seventh embodiment, the pulse tube refrigerator according to the eighth embodiment has an increased conduction surface, whereby cooling of the high-temperature-side wall portion 11*cd* of the pulse tube 11 and the heat radiating unit 12 can be performed better than in the sixth embodiment. As a result, the refrigerating quantity increases, as compared with the sixth embodiment.

(Ninth Embodiment)

Figure 10:
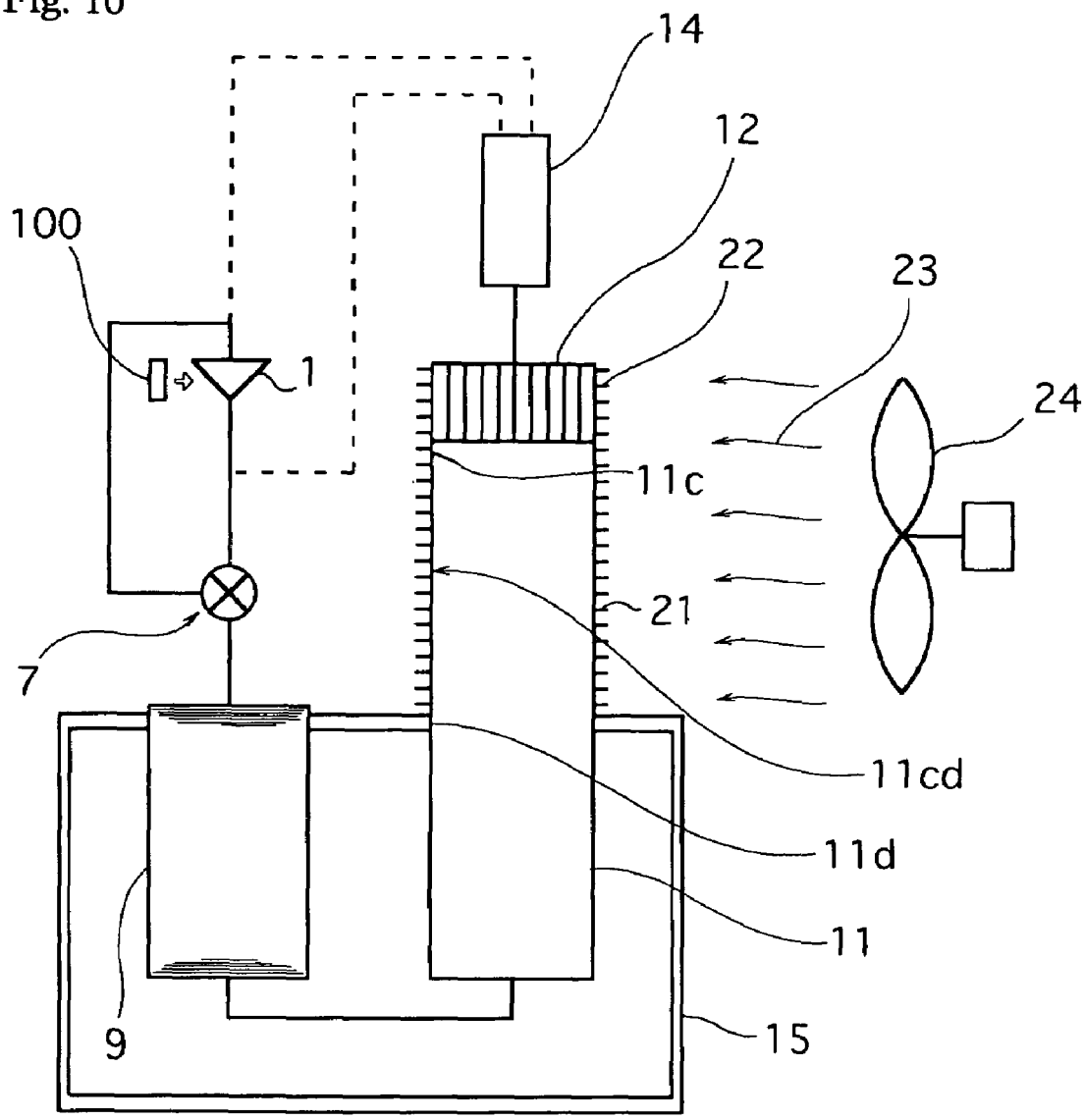
FIG. 10 is a circuit diagram showing the pulse tube refrigerator of the ninth embodiment according to the present invention.

As shown in FIG. 10, a pulse tube refrigerator according to a ninth embodiment is characterized in that air is forcedly caused to flow toward the high-temperature-side wall portion of the pulse tube and a pressure generation means 24 such as a fan is provided in the vicinity of the high-temperature-side wall portion 11*cd* and the heat radiating unit 12.

In the pulse tube refrigerator according to the ninth embodiment, heat transmission of air which cools the high-temperature-side wall portion 11*cd* and the heat radiating unit 12 is improved, whereby the degree of cooling by means of air is increased. As a result, the temperature of the high-temperature-side wall portion 11*cd* decreases, and the refrigerating capacity is increased by virtue of the same action as in the sixth embodiment.

(Tenth Embodiment)

Figure 11:
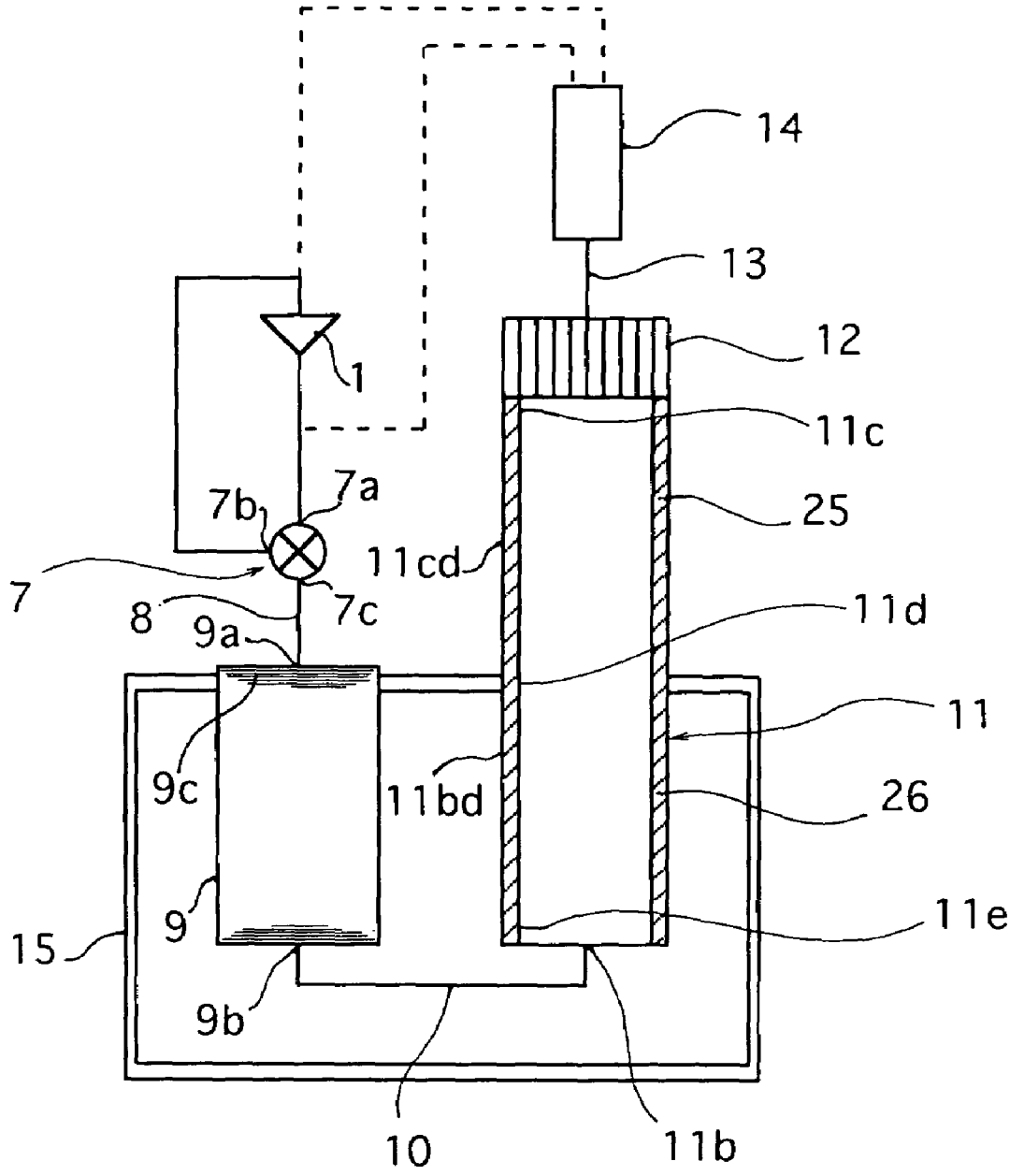
FIG. 11 is a circuit diagram showing the pulse tube refrigerator of the tenth embodiment according to the present invention.

As shown in FIG. 11, in a pulse tube refrigerator according to a tenth embodiment, the high-temperature-side tube portion 11*cd* of the pulse tube 11 disposed in the atmosphere is formed of a material 25 which has good heat conduction, and a low-temperature-side tube portion 11*bd* of the pulse tube 11 disposed within the vacuum tank 15 is formed of a material 26 which has poor heat conduction. The high-temperature-side tube portion 11*cd* and the low-temperature-side tube portion 11*bd* are joined together.

The material 25, which has good heat conduction, is copper, aluminum, or the like, and the material 26, which has poor heat conduction, is stainless steel or the like.

In the pulse tube refrigerator according to the tenth embodiment, the high-temperature-side tube portion of the pulse tube disposed in the atmosphere provides a high degree of heat conduction in the radial direction, whereby the temperature difference between the inner circumferential surface and the outer inner circumferential surface of the high-temperature-side tube portion decreases, the temperature of refrigerant in contact with the inner circumferential surface decreases, and the refrigerating capacity increases.

(Eleventh Embodiment)

Figure 12:
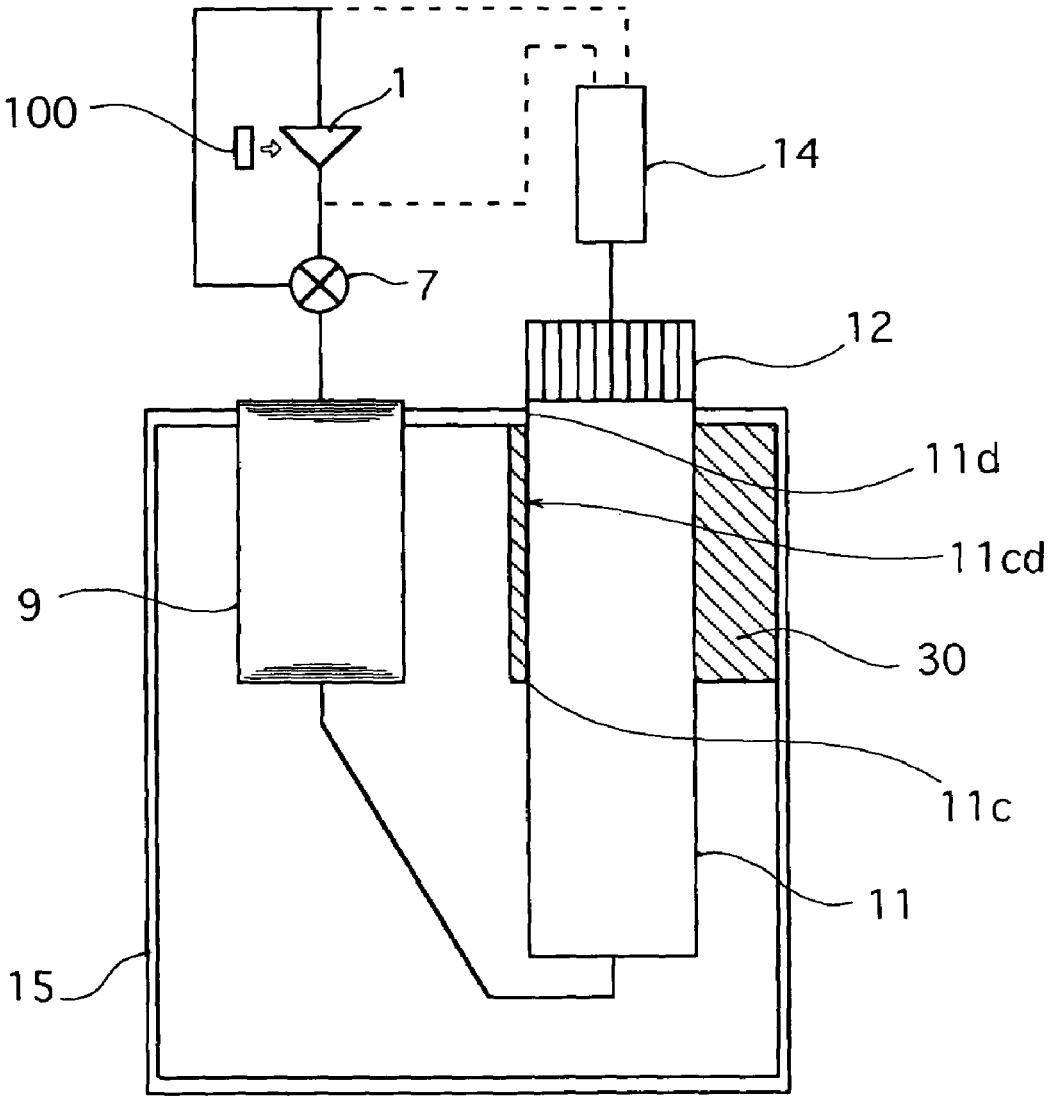
FIG. 12 is a circuit diagram showing the pulse tube refrigerator of the eleventh embodiment according to the present invention.

As shown in FIG. 12, in a pulse tube refrigerator according to an eleventh embodiment, one end of a conduction member 30 is brought into thermal contact with the high-temperature-side wall portion 11*cd* of the pulse tube 11, and the other end of the conduction member 30 is brought into thermal contact with the vacuum tank 15.

In the pulse tube refrigerator according to the eleventh embodiment, the high-temperature-side wall portion 11*cd* of the pulse tube 11 is cooled, via the conduction member 30, by means of the vacuum tank 15, which serves as a cooling source whose temperature is lower than the temperature of the high-temperature-side wall portion 11*cd* thereof, whereby the refrigerating capacity is increased.

In this case, the high-temperature-side wall portion 11*cd* of the pulse tube 11 may be disposed inside the vacuum tank or in the atmosphere outside the vacuum tank.

The above-described embodiments of the present invention, as herein disclosed, are taken as some embodiments for explaining the present invention. It is to be understood that the present invention should not be restricted by these embodiments and any modifications and additions are possible so far as they are not beyond the technical idea or principle, which would be considerable by a person with ordinary skill in the art, based on description of the scope of the patent claims, specification and figures.

Figure 13:
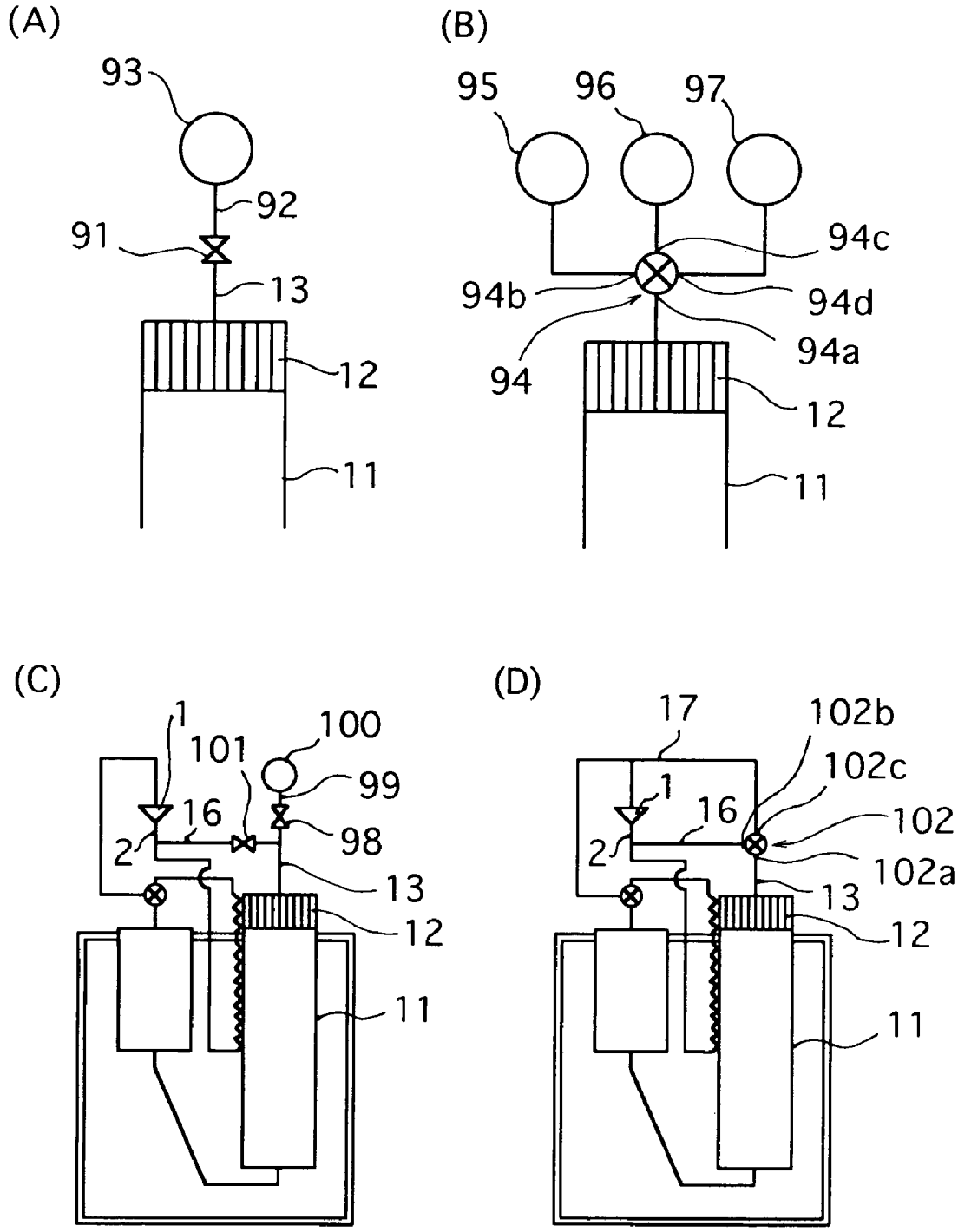
FIG. 13 is a circuit diagram showing four concrete examples of the phase adjuster of the embodiment according to the present invention.
Figure 14:
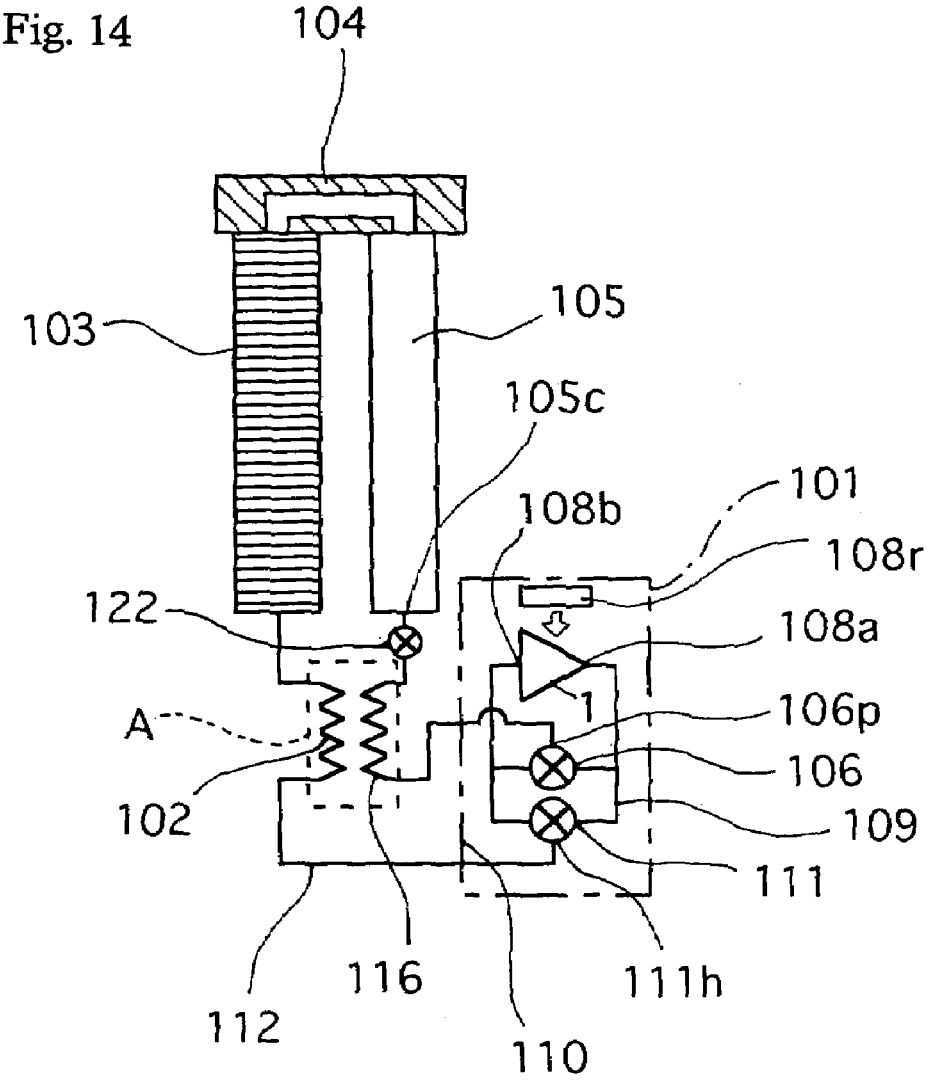
FIG. 14 is a circuit diagram showing a conventional pulse tube refrigerator.

The phase adjuster 14 used in the above-described embodiment may be of an orifice type shown in FIG. 13(A), an active buffer type shown in FIG. 13(B), a double-inlet type shown in FIG. 13(C), a 4-valve type shown in FIG. 13(D), or the like.

In the above-described embodiments, the pulse tube refrigerators are of a single stage type; however, the present invention is not limited thereto, and can be applied to pulse tube refrigerators having two or more stages.

INDUSTRIAL APPLICABILITY

Since the cooling means cools a high-temperature-side wall portion of the pulse tube by use of refrigerant of a pulse tube refrigerator, the temperature of the high-temperature-side wall portion of the pulse tube decreases. As a result, the quantity of heat which reaches the cold end of the pulse tube because of heat conduction decreases. In addition, since a portion of refrigerant gas in contact with the inner surface of the high-temperature-side wall portion of the pulse tube is cooled, the quantity of heat which reaches the cold end of the pulse tube because of movement of the refrigerant gas decreases. As a result, the refrigerating capacity is increased.

What is claimed is:

1. A pulse tube refrigerator comprising a pulse tube having a wall, wherein said pulse tube further includes a hot end that generates heat;

a cold reservoir, wherein said pulse tube is connected to said cold reservoir;

a vacuum tank, wherein said pulse tube is at least partially disposed inside of said vacuum tank; and a cooling device which cools a high-temperature-side portion of said wall of said pulse tube by use of a refrigerant which is lower in temperature than said high-temperature-side portion of said wall of said pulse tubes, wherein said cooling device extends along at least part of said high-temperature-side portion of said wall which is disposed inside of said vacuum tank, such that said cooling device cools said high-temperature-side portion of said wall inside of said vacuum tank.

2. A pulse tube refrigerator according to claim 1, wherein: said refrigerant which is used by said cooling device is a refrigerant which passes through said pulse tube.

3. A pulse tube refrigerator according to claim 2, wherein: said refrigerant flows out of a pressure source and flows into said cold reservoir.

4. A pulse tube refrigerator according to claim 2, wherein: said refrigerant flows between a discharge port of a pressure source and a high-pressure inlet port of a changeover valve communicating with said discharge port of said pressure source.

5. A pulse tube refrigerator according to claim 2, wherein: said refrigerant flows out of said cold reservoir and flows into a pressure source.

6. A pulse tube refrigerator according to claim 2, wherein: said refrigerant flows between a low-pressure outlet port of a changeover valve and a suction port of a pressure source.

7. A pulse tube refrigerator according to claim 2, wherein: said cooling device cools a heat radiating unit disposed at said hot end of said pulse tube, by use of said refrigerant, and wherein said refrigerant flows between a discharge side of a pressure source and a high-pressure inlet port of a changeover valve communicating with said discharge side of said pressure source.

8. A pulse tube refrigerator according to claim 2, wherein: said cooling device cools a heat radiating unit disposed at said hot end of said pulse tube, by use of said refrigerant, and wherein said refrigerant flows between a suction port of a pressure source and a low-pressure outlet port of a changeover valve communicating with said suction port of said pressure source.

9. A pulse tube refrigerator according to claim 2, wherein: a radiator is provided between a suction port of a pressure source and a low-pressure outlet port of a changeover valve communicating with said suction port of said pressure source;

said cooling device cools said high-temperature-side portion of said wall of said pulse tube by use of said refrigerant which flows out of said low-pressure outlet port of said changeover valve; and said refrigerant used to cool said high-temperature-side portion of said wall of said pulse tube is cooled by use of said radiator.

10. A pulse tube refrigerator according to claim 2, wherein:

a radiator is provided between a suction port of a pressure source and a low-pressure outlet port of a changeover valve communicating with said suction port of said pressure source;

said cooling device cools a heat radiating unit disposed at said hot end of said pulse tube by use of said refrigerant which flows out of said low-pressure outlet port of said changeover valve; and said refrigerant used to cool said heat radiating unit is cooled by use of the radiator.

11. A pulse tube refrigerator according to claim 1, wherein:

a first pressure source is provided for providing a flow between said pulse tube and said cold reservoir;

said refrigerant of said cooling device flows along a flow path to and from the cooling device;

a second pressure source is provided along said flow path; and said flow path is isolated from said cold reservoir such that said refrigerant flowing through said flow path does not enter said cold reservoir, and wherein said refrigerant flows continuously through said flow path.

12. A pulse tube refrigerator according to claim 1, wherein:

said pulse tube further includes a low-temperature-side portion of said wall which is disposed within said vacuum tank; and said cooling device extends along said high-temperature-side portion of said wall from a point on said wall of said pulse tube at which a temperature of said wall is higher than a temperature of an ambient atmospheric temperature to a point at said hot end of said pulse tube, so that heat conduction along said wall of said pulse tube from said high-temperature-side portion toward said low-temperature-side portion is reduced.

13. A pulse tube refrigerator according to claim 1, further comprising: a pressure source;

a changeover valve disposed between the pressure source and the cold reservoir;

a main circuit extending from a discharge port of the pressure source to a high-pressure inlet port of the changeover valve; and a branch circuit which branches off from the main circuit; wherein said cooling device is provided at the branch circuit.

14. A pulse tube refrigerator according to claim 13, wherein:

both one end and the other end of the branch circuit are connected with the main circuit.

15. A pulse tube refrigerator according to claim 14, wherein:

a flow-rate adjustment valve is provided between the pressure source and the high-pressure inlet port of the changeover valve; and one end of the branch circuit is connected with the main circuit between the pressure source and the flow-rate adjustment valve and the other end of the branch circuit is connected with the main circuit between the flow-rate adjustment valve and high-pressure inlet port of the changeover valve.

16. A pulse tube refrigerator according to claim 13, wherein:

one end of the branch circuit is connected with the main circuit, and the other end of the branch circuit is connected with a suction port of the pressure source.

17. A pulse tube refrigerator comprising:

a pulse tube having a wall, wherein said pulse tube further includes a hot end that generates heat;

a cold reservoir, wherein said pulse tube is connected to said cold reservoir;

a vacuum tank; and a cooling device which cools a high-temperature-side portion of said wall of said pulse tube by use of a cooling medium which is lower in temperature than said high-temperature-side portion of said wall of said pulse tube, wherein:

said cooling device includes at least part of said high-temperature-side portion of said wall of said pulse tube which is disposed outside of said vacuum tank and in the atmosphere, and wherein said at least part of said high-temperature-side portion is formed of a material having good heat conduction;

wherein said pulse tube further includes a low-temperature-side portion of said wall which is disposed within said vacuum tank, and which is formed of a material having poor heat conduction; and wherein said high-temperature-side portion and said low-temperature-side portion are joined together.

* * * * *